United States Patent [19]

Soung

[11] Patent Number: 4,459,138

[45] Date of Patent: Jul. 10, 1984

[54] RECOVERY OF ALKALI METAL CONSTITUENTS FROM CATALYTIC COAL CONVERSION RESIDUES

[75] Inventor: Wen Y. Soung, Houston, Tex.

[73] Assignee: The United States of America as represented by the United States Department of Energy, Washington, D.C.

[21] Appl. No.: 447,350

[22] Filed: Dec. 6, 1982

[51] Int. Cl.[3] ..... C10J 3/00

[52] U.S. Cl. ..... 48/197 R; 48/202; 48/210; 208/9; 502/22; 502/24; 502/25

[58] Field of Search ..... 48/197 R, 202, 210; 252/373; 208/9; 423/189, 339; 502/20, 21, 22, 24, 25, 27

[56] References Cited

U.S. PATENT DOCUMENTS 4,159,195 6/1979 Clavenna ..... 48/202

4,219,338 8/1980 Wolfs et al. ..... 48/197 R

*Primary Examiner*—Peter F. Kratz

*Attorney, Agent, or Firm*—Judson R. Hightower

[57] ABSTRACT

In a coal gasification operation (32) or similar conversion process carried out in the presence of an alkali metal-containing catalyst wherein particles containing alkali metal residues are produced, alkali metal constituents are recovered from the particles by contacting them (46, 53, 61, 69) with water or an aqueous solution to remove water-soluble alkali metal constituents and produce an aqueous solution enriched in said constituents. The aqueous solution thus produced is then contacted with carbon dioxide (63) to precipitate silicon constituents, the pH of the resultant solution is increased (81), preferably to a value in the range between about 12.5 and about 15.0, and the solution of increased pH is evaporated (84) to increase the alkali metal concentration. The concentrated aqueous solution is then recycled to the conversion process (86, 18, 17) where the alkali metal constituents serve as at least a portion of the alkali metal constituents which comprise the alkali metal-containing catalyst.

11 Claims, 1 Drawing Figure

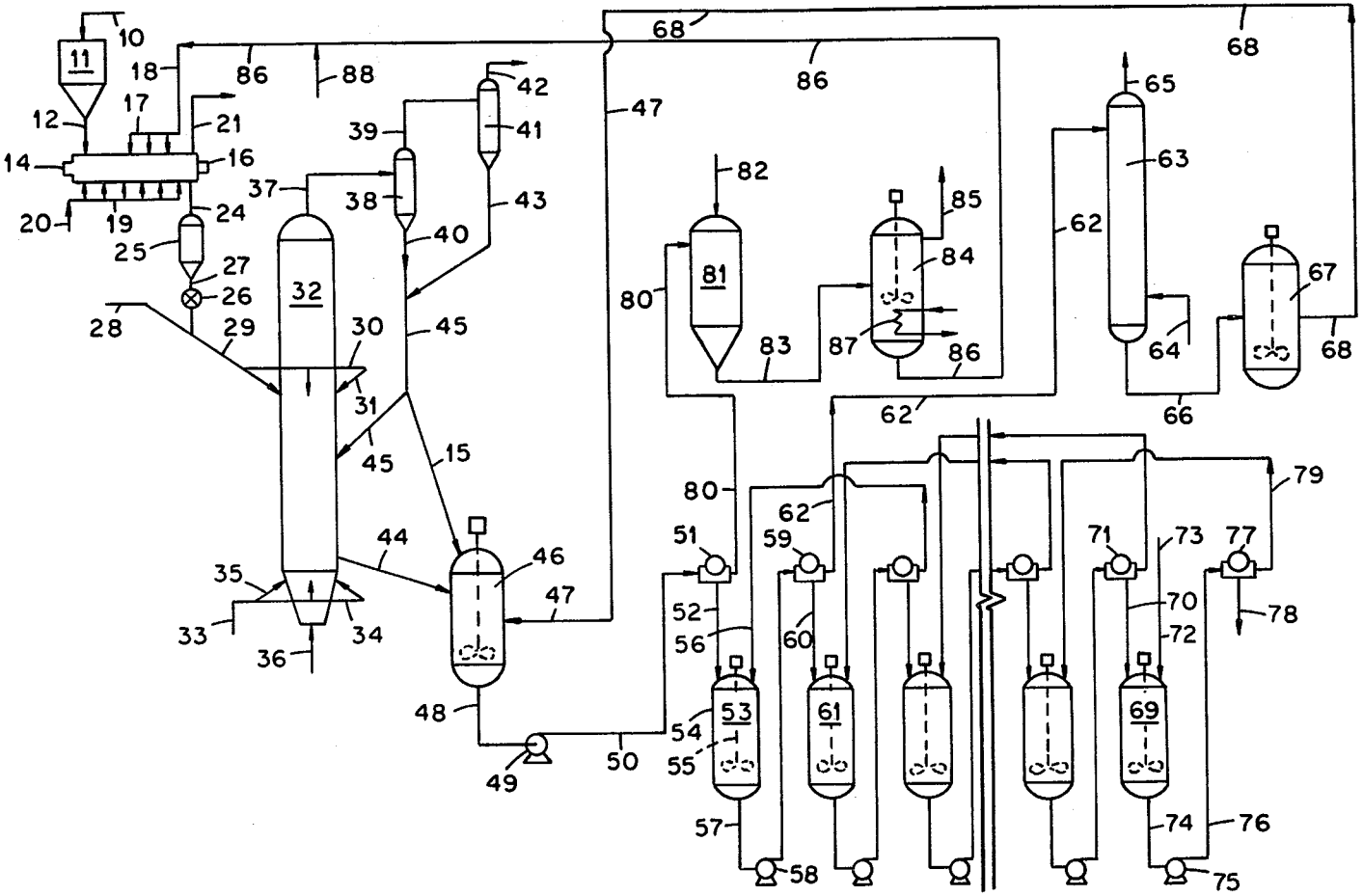

RECOVERY OF ALKALI METAL CONSTITUENTS FROM CATALYTIC COAL CONVERSION RESIDUES

The United Stated Government has rights in this invention pursuant to Contract No. ET-78-C-01-2777 between the U.S. Department of Energy and Exxon Research and Engineering Company.

This invention relates to the conversion of coal and similar carbonaceous solids in the presence of an alkali metal-containing catalyst and is particularly concerned with the recovery of alkali metal constituents from spent solids produced during coal gasification and similar operations and their re-use as constituents of the alkali metal-containing catalyst.

Potassium carbonate, sodium carbonate, potassium hydroxide and other alkali metal compounds have been recognized as useful catalysts for the gasification of coal and similar carbonaceous solids. The use of such compounds in coal liquefaction, coal carbonization, coal combustion and related processes has been proposed. To secure the higher reaction rates made possible by the presence of the alkali metal compounds, it has been suggested that bituminous coal, subbituminous coal, lignite, petroleum coke, organic waste and similar carbonaceous solids be mixed or impregnated with potassium, cesium, sodium or lithium compounds, alone or in combination with other metallic constituents, before such materials are reacted with steam, hydrogen, oxygen or other agents at elevated temperatures to produce gaseous and/or liquid products. Studies have shown that a wide variety of different alkali metal compositions can be used for this purpose, including both organic and inorganic salts, oxides, hydroxides and the like. In general, the above-described studies indicate that cesium compounds are the most effective gasification catalysts followed by potassium, sodium and lithium compounds in that order. Because of the relatively high cost of cesium compounds, most of the experimental work performed in this area in the past has been directed toward the use of compounds of potassium and sodium. This work has shown that potassium compounds are substantially more effective than the corresponding sodium compounds. Attention has therefore been focused on the use of potassium carbonate and potassium hydroxide.

Coal gasification processes and similar operations carried out in the presence of alkali metal compounds at high temperatures generally result in the formation of chars and alkali metal residues. The chars normally include unconverted carbonaceous constituents of the coal or other feed material and various inorganic constituents generally referred to as ash. It is generally advisable to withdraw a portion of the char from the reaction zone during gasification and similar operations in order to eliminate the ash and prevent it from building up within the reaction zone or other vessels in the system. In gasification and other processes referred to above that utilize alkali metal-containing catalysts, the cost of the alkali metal constituents is a significant factor in determining the overall cost of the process. In order to maintain catalyst cost at reasonable levels, it is essential that the alkali metal constituents be recovered and reused. One common method of recovering the alkali metal constituents is to wash out the char particles removed from the reaction zone with water in order to leach out the water-soluble alkali metal constituents.

Studies indicate that these constituents are generally present in part as carbonates and other water-soluble compounds which can be at least partially recovered by water washing. It has been found that between about 70 and 80 percent of the alkali metal present in the char particles can normally be recovered by this method.

The present invention provides an improved process for the recovery of alkali metal constituents from mixtures of char, ash and alkali metal residues produced during coal gasification and other conversion processes carried out in the presence of an alkali metal-containing catalyst, preferably a potassium-containing catalyst. In accordance with the invention, it has now been found that large amounts of alkali metal constituents can be recovered from particles containing alkali metal residues produced during coal gasification and related high temperature conversion processes in such a manner that the amount of makeup catalyst required and the potential for fouling of the equipment in the alkali metal recovery system by undesirable precipitates are minimized. The particles containing the alkali metal residues are contacted with water or an aqueous alkaline solution to remove the water-soluble alkali metal constituents and form an aqueous solution enriched in these alkali metal constituents. This aqueous solution is then contacted with carbon dioxide to precipitate silicon constituents and the pH of the resultant solution is increased to a value sufficiently high to prevent residual silicon constituents from precipitating when the aqueous solution is concentrated. After the pH adjustment step, the aqueous solution is concentrated to produce an enriched aqueous solution and the alkali metal constituents in this enriched solution are then used as at least a portion of the alkali metal constituents comprising the alkali metal-containing catalyst. Preferably, such use is achieved by recycling the concentrated solution directly to the conversion process.

The invention is based in part upon laboratory studies which indicate that alkali metal silicates are a major constituent of the solution obtained by leaching char particles produced during the fluid bed gasification of coal impregnated with an alkali metal carbonate or hydroxide catalyst. These water-soluble alkali metal silicates are not active catalysts and if they are directly recycled for reuse in the gasification process, a substantial amount of makeup catalyst will be required. Furthermore, if these silicates are not removed from the aqueous solution they will tend to precipitate and foul equipment in the alkali metal recovery system. It has been proposed to eliminate the silicates from solution by treating the solution with carbon dioxide to convert the alkali metal silicates to alkali metal carbonates, which are active gasification catalysts, and water-insoluble silica which can then be separated from the resultant aqueous solution before it is recycled to the process. It has also been found that when the aqueous solution formed by the carbon dioxide treatment is concentrated by removing a portion of the water prior to recycling, a silica precipitate tends to form. Laboratory studies indicate that formation of this precipitate can be avoided by raising the pH of the carbon dioxide treated solution prior to concentrating the solution.

The process of the invention makes it possible to recover alkali metal constituents present in the alkali metal residues withdrawn with the char from the conversion process without a substantial buildup of catalytically inactive species and water-insoluble constituent in the alkali metal recovery system. This, in turn, results in a substantial decrease in the amount of makeup alkali metal compounds required and in operating problems caused by fouling of equipment as the alkali metal constituents are recovered and recycled to the process. As a result the invention makes possible substantial savings in gasification and other conversion operations carried out in the presence of an alkali metal-containing catalyst and permits the generation of product gases and/or liquids at significantly lower cost than would otherwise be the case.

The drawing is a schematic flow diagram of a catalytic coal gasification process in which alkali metal constituents of the catalyst are recovered in accordance with the invention.

The process depicted in the drawing is one for the production of methane by the gasification of a bituminous coal, subbituminous coal, lignitic coal or similar carbonaceous solids with steam at high temperatures in the presence of a carbon-alkali metal catalyst prepared by impregnating the feed solids with a solution of an alkali metal compound or a mixture of such compounds, preferably potassium carbonate, potassium hydroxide or a mixture thereof, and thereafter heating the impregnated material to a temperature sufficient to produce an interaction between the alkali metal and the carbon present. It will be understood that the alkali metal recovery system disclosed is not restricted to this particular gasification process and that it can be employed in conjunction with any of a variety of other conversion processes in which alkali metal compounds or carbon-alkali metal catalysts are used to promote the reaction of steam, hydrogen, oxygen, or the like with carbonaceous feed materials to produce a char, coke or similar solid product containing alkali metal residues from which alkali metal compounds are recovered for reuse as the catalyst or constituents of the catalyst. It can be employed, for example, in the recovery of alkali metal compounds from various processes for the gasification of coal, petroleum coke, lignite, organic waste materials and similar solid feed streams which produce spent carbonaceous solids. Other conversion processes with which it may be used include operations for the carbonization of coal and similar feed solids, for the liquefaction of coal and related carbonaceous materials, for the retorting of oil shale, for the partial combustion of carbonaceous feed material, and the like. Such processes have been disclosed in the literature and will be familiar to those skilled in the art.

In the process depicted in the drawing, a solid carbonaceous feed material such as bituminous coal, subbituminous coal, lignitic coal, or the like that has been crushed to a particle size of about 8 mesh or smaller on the U.S. Sieve Series Scale is passed into line 10 from a feed preparation plant or a storage facility that is not shown in the drawing. The solids introduced into line 10 are fed into a hopper or similar vessel 11 from which they are passed through line 12 into the feed preparation zone 14. This zone contains a screw conveyor or similar device, not shown in the drawing, that is powered by a motor 16, a series of spray nozzles or similar devices 17 for the spraying of alkali metal-containing solution supplied through line 18 onto the solids as they are moved through the preparation zone by the conveyor, and a similar set of nozzles of the like 19 for the introduction of a hot dry gas, such as flue gas or superheated steam, into the preparation zone. The hot gas, supplied through line 20, serves to heat the impregnated solids and drive off the moisture. A mixture of water vapor and gases is withdrawn from the feed preparation zone through line 21 and passed to a condensor, not shown, from which water may be recovered for use as makeup or the like. The alkali metal-containing solution is recycled through line 86 from the alkali metal recovery section of the process, which is described in detail hereinafter.

It is preferred that sufficient alkali metal-containing solution be introduced into the feed preparation zone 14 to provide from about 3 to about 50 weight percent of the alkali metal compound or mixture of such compounds on the coal or other carbonaceous solids. From about 5 to about 20 weight percent is generally adequate. The dried impregnated solid particles prepared in zone 14 are withdrawn through line 24 and passed to a closed hopper or similar vessel 25. From here they are discharged through a starwheel feeder or equivalent device 26 in line 27 at an elevated pressure sufficient to permit their entrainment into a stream of high pressure steam, recycle product gas, inert gas, or other carrier gas introduced into line 29 via line 28. The carrier gas and entrained solids are passed through line 29 into manifold 30 and fed from the manifold through feed lines 31, and nozzles, not shown in the drawing, into gasifier 32. In lieu of or in addition to hopper 25 and starwheel feeder 26, the feed system may employ parallel lock hoppers, pressurized hoppers, aerated standpipes operated in series, or other apparatus to raise the input feed solids stream to the required pressure level.

Gasifier 32 comprises a refractory lined vessel containing a fluidized bed of carbonaceous solids extending upward within the vessel above an internal grid or similar distribution device not shown in the drawing. The bed is maintained in the fluidized state by means of steam introduced through line 33, manifold 34 and peripherally spaced injection lines and nozzles 35 and by means of recycle hydrogen and carbon monoxide introduced through bottom inlet line 36. The particular injection system shown in the drawing is not critical, hence other methods for injecting the steam and recycle hydrogen and carbon monoxide may be employed. In some instances, for example, it may be preferred to introduce both the steam and recycle gases through multiple nozzles to obtain more uniform distribution of the injected fluid and reduce the possibility of channeling and related problems.

The injected steam reacts with carbon in the feed material in the fluidized bed in gasifier 32 at a temperature within the range between about 425° C. and about 870° C., preferably between about 600° C. and about 760° C., and at a pressure between about 7.0 and about 140 kg/cm$^2$, preferably between about 14 and about 35 kg/cm$^2$. Due to the equilibrium conditions existing in the bed as the result of the presence of the carbon-alkali metal catalyst and the recycle hydrogen and carbon monoxide injected near the lower end of the bed, the net reaction products will normally consist essentially of methane and carbon dioxide. The ratio of methane to carbon monoxide in the raw product gas thus formed will preferably range from about 1.0 to about 1.4 moles per mole, depending upon the amount of hydrogen and oxygen in the feed coal or other carbonaceous solids. The coal employed may be considered as an oxygenated hydrocarbon for purposes of describing the reaction. A Wyoming coal, for example, may be considered as having the approximate formula $CH_{0.84}O_{0.20}$, based on the ultimate analysis of moisture and ash-free coal and neglecting nitrogen and sulfur. The reaction of this coal with steam to produce methane and carbon dioxide is as follows:

$$1.24H_2O(g)+1.8CH_{0.84}O_{0.20}\rightarrow 0.8CO_2+CH_4$$

Under the same gasification conditions, coals of higher oxygen content will normally produce lower methane to carbon dioxide ratios and those of lower oxygen content will yield higher methane to carbon dioxide ratios.

The gas leaving the fluidized bed in gasifier 32 passes through the upper section of the gasifier, which serves as a disengagement zone where particles too heavy to be entrained by the gas leaving the vessel are returned to the bed. If desired, this disengagement zone may include one or more cyclone separators or the like for removing relatively large particles from the gas. The gas withdrawn from the upper part of the gasifier through line 37 will normally contain methane, carbon dioxide, hydrogen, carbon monoxide, unreacted steam, hydrogen sulfide, ammonia, and other contaminants formed from the sulfur and nitrogen contained in the feed material, and entrained fines. This gas is introduced into cyclone separator or similar device 38 for removal of the larger fines. The overhead gas then passes through line 39 into a second separator 41 where smaller particles are removed. The gas from which the solids have been separated is taken overhead from separator 41 through line 42 and the fines are discharged downward through diplegs 40 and 43. A portion of these fines is normally returned to the gasifier via line 45 while the remainder is passed through line 15 into tank 46.

After entrained solids have been separated from the raw product gas as described above, the gas stream may be passed through suitable heat exchange equipment for the removal of acid gases. Once this has been accomplished, the remaining gas, consisting primarily of methane, hydrogen and carbon monoxide, may be cryogenically separated into a product methane stream and a recycle stream of hydrogen and carbon monoxide which is returned to the gasifier through line 36. Conventional gas processing equipment can be used. Since a detailed description of this downstream gas processing portion of the process is not necessary for an understanding of the invention, it has been omitted.

The fluidized bed in gasifier 32 is comprised of char particles formed as the solid carbonaceous feed material undergoes gasification. The composition of the char particles will depend upon the amount of mineral matter present in the carbonaceous solids fed to the gasifier, the amount of alkali metal compound or mixture of such compounds impregnated into the feed material, and the degree of gasification that the char particles undergo while in the fluidized bed. The lighter char particles, which will have a relatively high content of carbonaceous material, will tend to remain in the upper portion of the fluidized bed. The heavier char particles, which will contain a relatively small amount of carbonaceous material and a relatively large amount of ash and alkali metal residues, will tend to migrate toward the bottom of the fluidized bed. A portion of the heavier char particles is normally withdrawn from the bottom portion of the fluidized bed in order to eliminate ash and thereby prevent it from building up within the gasifier and other vessels in the system. During the gasification process taking place in reactor 32, alkali metal residues containing water-soluble alkali metal compounds such as carbonates, sulfides, thiosulfates, sulfates, hydroxides, metasilicates, hydrosilicates, and the like, and water-insoluble compounds such as alkali metal aluminosilicates, alkali metal iron sulfides and similar compounds are formed. To improve the economics of the catalytic gasification process described above and other catalytic conversion processes where alkali metal residues are formed and withdrawn with char and ash from the gasifier or the reaction zone, it has been proposed to leach the char particles with water or an aqueous solution in a multistage countercurrent leaching system to recover the water-soluble constituents.

Referring again to the drawing, char particles containing carbonaceous material, ash and alkali metal residues are continuously withdrawn from the fluidized bed in gasifier 32 through transfer line 44, passed through equipment not shown in the drawing in order to depressurize the solids and decrease their temperature, and introduced into slurry tank 46. Here the particles are mixed with char fines recovered from the raw product gas through diplets 40 and 43 and line 15, and a slurry comprising an aqueous solution containing water-soluble alkali metal constituents introduced into the slurry tank through line 47. The aqueous portion of the slurry introduced into tank 46 will normally consist of an alkali metal-containing solution having a pH between about 7.5 and about 10.0 produced by washing the solids in tank 46 in a countercurrent multistage extraction system and subsequently stripping the resultant solution with carbon dioxide as described in detail hereinafter. During the slurrying process which takes place in tank 46, a portion of the water-soluble constituents present in the alkali metal residues passed into the tank with the char will dissolve in the water thereby further enriching the solution in alkali metal constituents. If the char has not been exposed to molecular oxygen or a gas, such as air, that contains molecular oxygen prior to its introduction into tank 46, the alkali metal constituents which dissolve in the aqueous medium will be primarily in the form of alkali metal carbonates, alkali metal sulfides, alkali metal hydroxides, alkali metal metasilicates, and alkali metal hydrosilicates. It is important that these constituents not be exposed to air or any other oxygen-containing gases since some of these alkali metal constituents may have a tendency to oxidize and form undesirable alkali metal sulfates and alkali metal thiosulfates. These latter alkali metal compounds are relatively inactive catalysts as compared to alkali metal carbonates, hydroxides and sulfides and therefore the more of them that are produced during the recovery step, the greater is the amount of active alkali metal compounds that must be introduced into the system to compensate for the loss of the more active constituents. To prevent the slurry in tank 46 from coming in contact with air or another oxygen-containing gas, steam, nitrogen, carbon dioxide or a similar gas free of molecular oxygen can be passed into the top of the tank to form an inert blanket over the slurry. This same procedure can be used in the slurry tanks which comprise the multistage extraction system described in detail hereinafter.

The slurry formed in tank 46 is withdrawn through line 48 and passed by means of pump 49 through line 50 to filter, hydroclone, centrifuge, settler or similar solids-liquid separation device 51 where a large portion of the particles is removed from the liquid. The particles removed from the liquid in separation device 51 and withdrawn through line 52 will contain water-soluble alkali metal constituents that did not pass into solution during slurrying in tank 46 and entrained liquid containing water-soluble alkali metal constituents. Depending upon the type of coal or similar carbonaceous solids fed to gasifier 32 and other factors, the particles may also contain water-insoluble alkali metal residues. The water-soluble alkali metal constituents remaining in the particles are recovered by passing the solids through a multistage countercurrent aqueous extraction unit which includes a plurality of tanks or vats, classifiers, screw-fed contactors, thickeners, continuous centrifuges or the like. The number of actual stages employed in the extraction system will depend to a large extent upon the composition of the solids fed to the system and the particular contacting conditions utilized. Each stage in the particular system shown in the drawing includes a closed vat or tank containing a stirrer, means for countercurrent circulation of liquids and solids from one tank to another, and a filter, centrifuge, hydroclone or a similar solids-liquid separation device. Although the drawing shows that each stage is comprised of a tank and a separate liquids-solid device, it will be understood that these two functions can be combined into one device which will then serve as a stage itself. An example of such a device is a gravity settler in which contacting of the particles with liquid and their subsequent separation from the liquid occur simultaneously.

The solids removed from the slurry fed to separation device 51 are passed through line 52 into the final stage 53 of the multistage solids-liquid extraction train. This stage comprises a mixing tank 54 which contains a stirrer 55. In the mixing tank solids are slurried with an aqueous solution containing a high concentration of alkali metal constituents introduced into the tank through line 56 and the resultant slurry is agitated by the stirrer. The temperature in the tank is normally maintained at a value between about 20° C. and about 150° C., preferably at a value near the boiling point of the aqueous medium. Water-soluble alkali metal constituents present in the solid particles are in part extracted by the liquid in contact with the particles.

The slurry which is formed in stage 53 is withdrawn from the bottom of tank 54 through line 57 and circulated by means of pump 58 to solids-liquid separation device 59 where the solids are removed from the liquid. These solid particles, from which a portion of the water-soluble alkali metal constituents have been extracted, are discharged through line 60 into stage 61 of the apparatus. The liquid separated from the solids in filter 59, richer in alkali metal constituents than the liquid in stage 61, is withdrawn from the filter through line 62. This solution will normally have a pH between about 10.0 and about 13.0, and will contain between about 5.0 and about 20 mole percent of alkali metal metasilicates and alkali metal hydrosilicates. This relatively high concentration of silicates in the aqueous solution is undesirable for two reasons. First, the silicates are not catalytically active and therefore catalyst makeup requirements for the process are relatively large. Secondly, the silicates tend to build up within the alkali metal recovery and recycle system and may form precipitates that will foul equipment and lead to subsequent operational problems.

The alkali metal metasilicates and hydrosilicates in the solution removed from filter 59 through line 62 are removed by contacting the solution with carbon dioxide. The solution is passed through line 62 into contactor or similar vessel 63 where it is passed downward through a contacting zone at the same time as a carbon dioxide-containing gas is introduced through line 64 into the bottom of the contactor. Normally, this gas will comprise a carbon dioxide-containing stream recovered from the raw product gas exiting gasifier 32 through line 37. As the carbon dioxide-containing gas rises upward through the downflowing aqueous solution, the carbon dioxide in the gas reacts with the alkali metal metasilicates and alkali metal hydrosilicates to form alkali metal carbonates, alkali metal bicarbonates, and water-insoluble silica. The extent to which this reaction goes to completion is dependent on the pH of the aqueous solution. To obtain maximum conversion of the alkali metal silicates to carbonates and silica, it is normally preferable to use a sufficient amount of carbon dioxide to lower the pH to a value in the range between about 7.5 and about 9.0. Alumina and iron oxide precipitates may also form if the aqueous solution contains alkali metal aluminates and iron compounds. In addition, the carbon dioxide-containing gas strips sulfides, bisulfides, polysulfides and polybisulfides out of the aqueous solution in the form of hydrogen sulfide and converts their cationic counterparts into alkali metal carbonates or bicarbonates.

A gas depleted in carbon dioxide is withdrawn overhead of contactor 63 through line 65 and further processed for the recovery of the hydrogen sulfide. The contacting vessel utilized does not necessarily have to be of the type shown in the drawing and may be any type of vessel that allows for fairly good contacting between the carbon dioxide-containing gas and the aqueous alkali metal-containing solution. A simple tank in which the carbon dioxide-containing gas is bubbled through the aqueous solution may be sufficient for purposes of the invention.

The slurry effluent from contacting vessel 63 which contains primarily alkali metal carbonates and bicarbonates dissolved in water and precipitated silica, is withdrawn from the bottom of the vessel through line 66 and passed to holding tank 67. Here the slurry is allowed to sit for between about 1.0 and about 5.0 hours while undergoing mild agitation in order to allow the precipitated silica, alumina and iron oxide particles to grow or agglomerate and thereby facilitate their subsequent separation from the solution. It has been found that a retention time in the range between about 1.5 and about 3.0 hours will result in the removal of between about 90 weight percent and about 98 weight percent of the precipitated silica, alumina and iron oxides from the solution via filtration.

After the slurry has remained in holding tank 67 for a sufficient time to allow agglomeration of the precipitated silica, alumina and iron oxides, it is withdrawn through line 68 and passed through line 47 into slurry tank 46. Here the slurry is mixed with the char particles leaving gasifier 32 and the aqueous portion of the slurry will begin to leach alkali metal constituents from these char particles as described earlier. The pH of the aqueous portion of the slurry introduced into the tank through line 47 will normally range between about 7.5 and about 10.0, preferably between about 8.0 and about 9.0. At this relatively low pH, only a very small amount of silicates will be extracted from the char particles in the form of water-soluble alkali metal metasilicates and hydrosilicates. The agglomerated silica, alumina and iron oxide particles produced in holding tank 67 are removed from the aqueous solution produced in slurry tank 46 in filter or similar solids-liquid separation device 51.

Stage 61 and the other intermediate stages of the alkali metal recovery train are generally similar to stage 53. In each of these stages, solids separated from a relatively concentrated liquid stream in the solids-liquid separator associated with that stage are discharged into a less concentrated solution and the concentrated solution from the separator is passed downstream for contact with solids having a higher content of water-soluble alkali metal constituents. Slurry from each stage is pumped to the solids-liquid separator in the adjacent upstream stage for separation into liquid and solid components. In the initial stage 69 of the train, incoming slurry from the second stage flows through line 70 to solids-liquid separator 71 from which the solids are discharged through line 72 into substantially pure water introduced into the stage through line 73.

The slurry formed in initial stage 69 by the mixing of substantially pure water with solids from which most of the water-soluble alkali metal constituents have been extracted results in a very dilute alkali metal solution. The slurry is withdrawn through line 74 by means of pump 75 and passed through line 76 to solids-liquid separation device 77. The solids withdrawn from the separation device through line 78 will normally contain, among other substances, small amounts of carbonaceous material, alumina, silica, other ash constituents, and a small amount of water-insoluble alkali metal constituents. These solids may be further treated in such a fashion as to recover the water-insoluble alkali metal constituents or they may be disposed of by landfill, used for construction purposes, or employed in other applications. The very dilute alkali metal solution recovered from filter 77 is passed through line 79 into the second stage of the recovery train.

The aqueous solution produced by passing the slurry in tank 46 through separation device 51 is removed from the separation device through line 80 and will normally have a pH between about 9.0 and about 13.0. It is desired to reuse the alkali metal constituents in this solution as constituents of the carbon-alkali metal catalyst employed in gasifier 32. Normally, the reuse of these alkali metal constituents would be accomplished by removing water from the aqueous solution to increase the concentration of alkali metal constituents and then recycling the concentrated solution to feed preparation zone 14 where the coal or similar carbonaceous feed material is impregnated with the alkali metal constituents in the concentrated solution. It has been surprisingly discovered, however, that when this aqueous solution is concentrated, a precipitate of silica forms in the concentrating equipment. This has been found to occur even though the aqueous solution is first treated with carbon dioxide to precipitate silicon constituents. Evidently, some silica particles remain in a colloidal suspension and do not precipitate with the other solids. As the solution is concentrated, the small colloidal silica particles grow to such a size as to form precipitates. It has been discovered that the formation of these precipitates can be avoided in the concentration step by raising the pH of the solution fed to the concentration step.

Referring again to the drawing, the aqueous solution in line 80 is passed into agitated mixer or similar vessel 81. Here the solution is mixed with sufficient base introduced through line 82 to raise the pH of the solution to a value in the range between about 12.5 and about 15.0, preferably between about 13.0 and about 14.0. The addition of base results in the conversion of water-insoluble silica present in the solution into water-soluble silicates and thereby prevents silica precipitation during subsequent concentration operations. The base added to vessel 81 through line 82 may be any strong base capable of increasing the pH into the desired range. Examples of such bases include sodium hydroxide, ammonium hydroxide, potassium hydroxide and the like. Preferably, the base will be in the form of makeup alkali metal constituents which are required to compensate for the constituents that are tied up as water-insoluble compounds in the residues formed in gasifier 32 and inactive water-soluble constituents extracted from the char residue. Normally, the makeup catalyst will be in the form of an alkali metal hydroxide, preferably potassium hydroxide.

The solution exiting vessel 81 will normally have an alkali metal concentration ranging between about 2.0 and about 15.0 weight percent. This solution must be concentrated before recycling to feed preparation zone 14. In order to accomplish this concentration, the solution is passed through line 83 into evaporator 84. Here the solution is continuously agitated in the presence of steam coil 87. The solution is held in contact with the steam coil for a time sufficient to allow water to vaporize from the solution and thereby substantially increase the concentration of alkali metal constituents. Normally, between about 50 and about 90 weight percent of the water in the solution is evaporated to produce a solution containing between about 20 weight percent and about 30 weight percent alkali metal constituents. The steam produced by evaporation is withdrawn from vessel 84 through line 85. The concentrated solution produced in the evaporator is withdrawn from the vessel through line 86 and recycled, along with makeup alkali metal constituents introduced into line 86 via line 88, through lines 18 and 17 to feed preparation zone 14. Here the coal or similar carbonaceous material is impregnated with the alkali metal constituents in the concentrated solution.

In the embodiment of the invention shown in the drawing and described above, the aqueous portion of the slurry in tank 53 is removed from the slurry solids in separation device 59 and subsequently treated with carbon dioxide to convert alkali metal silicates to alkali metal carbonates and silica. It will be understood that the carbon dioxide treatment does not necessarily have to be conducted on this particular liquid stream from the alkali metal recovery system or after the liquid has been separated from the solids. For example, the carbon dioxide treatment can be conducted on one of the liquids streams from another separation device in the alkali metal recovery train shown in the drawing or it can be carried out in situ on the slurry in tank 53 and/or on the slurries in the other tanks comprising the alkali metal recovery system. The latter option can be carried out by passing a carbon dioxide-containing gas directly into the tanks in the alkali metal recovery train and allowing the gas to contact the slurry as it is agitated. Any precipitated materials formed in situ will then be removed in the filter or other solids-liquid separation devices associated with that tank.

It will also be understood that the process of the invention is particularly applicable to an alkali metal recovery system in which the particles leaving the conversion process are treated with water to recover water-soluble alkali metal constituents from the alkali metal residues produced in the conversion process. Normally, the process of the invention will not be used in conjunction with alkali metal recovery systems in which particles containing alkali metal residues are treated with an aqueous solution containing a substance that will facilitate the conversion of water-insoluble alkali metal constituents in the residues into water-soluble alkali metal constituents. Examples of such recovery systems include systems in which particles containing alkali metal residues are treated with an aqueous solution of an acid at relatively low temperatures, and systems in which such particles are treated with calcium hydroxides or other calcium compounds in the presence of water at a temperature between about 250° F. and about 700° F.

It will be apparent from the foregoing that the invention provides a process which makes it possible to recover catalytically active alkali metal constituents from alkali metal residues produced during catalytic coal gasification and similar high temperature conversion processes without the need for large amounts of makeup catalyst and without fouling of equipment in the alkali metal recovery system. As a result, the overall cost of the conversion process is substantially lowered.

I claim:

1. A process for the conversion of a solid carbonaceous feed material in the presence of an alkali metal-containing catalyst into liquids and/or gases wherein particles containing alkali metal residues are produced, which comprises:

(a) contacting said particles containing said alkali metal residues with water or an aqueous alkaline solution to remove water-soluble alkali metal constituents from said particles and thereby form an aqueous solution enriched in said alkali metal constituents;

(b) contacting said aqueous solution enriched in said alkali metal constituents with carbon dioxide to precipitate silicon constituents contained in said solution;

(c) increasing the pH of the aqueous solution produced in step (b) to a value sufficiently high to prevent residual silicon constituents in said aqueous solution from precipitating when said aqueous solution is concentrated;

(d) concentrating the aqueous solution formed in step (c) to produce an aqueous solution richer in alkali metal constituents; and (e) using the alkali metal constituents in the aqueous solution produced in step (d) in said conversion process as at least a portion of the alkali metal constituents comprising said alkali metal-containing catalyst.

2. A process according to claim 1 in which said conversion process comprises gasification.

3. A process according to claim 1 in which said carbonaceous feed material comprises coal.

4. A process according to claim 2 in which said carbonaceous feed material comprises coal.

5. A process according to claim 1 in which said particles containing said alkali metal residues are contacted with water or an aqueous solution in a multistage countercurrent extraction system.

6. A process according to claim 1 in which the pH of said aqueous solution produced in step (b) is increased to a value in the range between about 12.5 and about 15.0.

7. A process according to claim 1 in which said aqueous solution enriched in alkali metal constituents produced in step (a) is contacted with carbon dioxide while still in contact with said particles containing said alkali metal constituents.

8. A process according to claim 1 in which said aqueous solution enriched in alkali metal constituents produced in step (a) is separated from said particles containing said alkali metal residues prior to contacting with said carbon dioxide.

9. A process according to claim 1 in which said particles comprise char particles containing carbonaceous material, ash and alkali metal residues.

10. A process according to claim 1 in which said alkali metal-containing catalyst comprises a potassium-containing catalyst.

11. A process according to claim 1 in which the pH of said aqueous solution produced in step (b) is increased by adding an alkali metal hydroxide, preferably potassium hydroxide.

* * * * *